US006382772B1

(12) United States Patent
Kamiyama et al.

(10) Patent No.: US 6,382,772 B1
(45) **Date of Patent: *May 7, 2002**

(54) INK JET HEAD, APPARATUS AND METHOD HAVING INDIVIDUALLY-DRIVABLE HEAT GENERATING RESISTORS VARIABLY SPACED FROM AN EJECTION OUTLET

(75) Inventors: Yuji Kamiyama, Fujisawa; Hiroyuki Ishinaga, Tokyo; Yoshiyuki Imanaka, Yokohama; Masaaki Izumida, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,925

(22) Filed: Aug. 26, 1999

Related U.S. Application Data

(62) Division of application No. 08/659,324, filed on Jun. 6, 1996, now Pat. No. 6,003,973.

(30) Foreign Application Priority Data

Jun. 6, 1995 (JP) ..... 7-139142

(51) Int. Cl.[7] ..... B41J 2/05; B41J 2/14; B41J 2/205

(52) U.S. Cl. ..... 347/57; 347/48; 347/15

(58) Field of Search ..... 347/57, 48, 15, 347/20, 54, 61, 62, 12, 14, 63, 23, 49, 50, 87

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,458,256 A | | 7/1984 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,604,654 A | | 8/1986 | Sakurada et al. | 347/15 |
| 4,723,129 A | | 2/1988 | Endo et al. | 346/1.1 |
| 4,740,796 A | | 4/1988 | Endo et al. | 346/1.1 |
| 4,965,594 A | | 10/1990 | Komuro | 346/140 R |
| 5,121,143 A | | 6/1992 | Hayamizu | 346/140 R |
| 5,148,192 A | | 9/1992 | Izumida et al. | 346/140 R |
| 5,172,139 A | | 12/1992 | Sekiya et al. | 346/140 R |
| 5,371,528 A | | 12/1994 | Izumida et al. | 347/87 |
| 5,731,828 A | * | 3/1998 | Ishinaga et al. | 347/57 |
| 6,003,973 A | * | 12/1999 | Kamiyama et al. | 347/57 |

FOREIGN PATENT DOCUMENTS

| | | |
|---|---|---|
| EP | 0 372 097 | 6/1990 |
| EP | 0 707 964 | 4/1996 |
| JP | 54-56847 | 5/1979 |
| JP | 55-132259 | 10/1980 |
| JP | 59-138461 | 8/1984 |
| JP | 60-71260 | 4/1985 |
| JP | 1-237152 | 9/1989 |
| JP | 6-198914 | 7/1994 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

An ink jet head includes ink ejection outlet for ejecting ink, a plurality of heat generating resistors for generating thermal energy contributable to ejecting the ink, and ink flow path comprising the plurality of the heat generating resistors and being in fluid communication with the ejection outlet, the heat generating resistors generating the thermal energy upon receiving a driving signal, so that a bubble is generated in the ink within the ink flow path to eject the ink through the ink ejection outlet; wherein the plurality of the heat generating resistors are arranged in parallel, relative to the ink ejecting direction, in the ink flow path, and the distances from the heat generating centers of the heat generating resistors to the ejection outlet are different.

1 Claim, 9 Drawing Sheets

INK JET HEAD, APPARATUS AND METHOD HAVING INDIVIDUALLY-DRIVABLE HEAT GENERATING RESISTORS VARIABLY SPACED FROM AN EJECTION OUTLET

CROSS-REFERENCE TO RELATED APPLICATION

This application is a division of application Ser. No. 08/659,324, filed on Jun. 6, 1996, and now U.S. Pat. No. 6,003,973.

FIELD OF THE INVENTION AND RELATED ART

The present invention relates to an ink jet head which ejects ink toward a recording medium in response to driving signals, and an ink jet apparatus which records characters images, pictures images. and/or the like, on the recording medium by employing the ink jet head. It also relates to an ink jet recording method for recording images with gradation by driving a plurality of heat generating resistors.

The ink jet apparatus does not generate noise, can record at a high speed, and can easily record color images; therefore, it has come to be widely used as a means for recording images on a recording medium such as a sheet of paper, in various apparatuses, for example, a word processor, a facsimile apparatus, a copying apparatus, or a printer.

The ink jet head is mounted in an ink jet apparatus, as a member which records character images, picture images and/or the like, on the recording medium by ejecting ink from the ink jet portions in response to driving signal input from the ink jet apparatus. More specifically, the ink jet head ejects ink using the thermal energy generated in response to the driving signals from the ink jet apparatus.

FIG. 8 is a schematic perspective view of an ink Jet head, and FIG. 9 is a schematic section of the same ink jet head.

A reference numeral 40 designates an ejection orifice from which the ink is ejected; 41, a first substrate; 41*a*, a heat generating resistor disposed on the first substrate 41 in order to generate a bubble in the ink by heating the ink; 42, a second substrate; 42*a*, an ink path; 42*b*, an ink chamber; and 42*c* designates an ink supply port.

As is evident from the drawing, the first substrate 41 and the second substrate 42 are joined to form the ink path 42*a* and the ink chamber 42*b*. The ink is.supplied through the ink supply port 42*c*, and is delivered to the ink chamber 42*b*, and then to the ink path 42*a*. The heat generating resistor 41*a* provided within the ink path 42*a* generates heat in response to the driving signals sent from the driving signal supplying means of the ink jet apparatus. The heat generates a bubble in the ink within the ink path, and as the bubble develops, the ink within the ink path 42*a* is ejected toward the recording medium from the ejection orifice 40.

Incidentally, as the ink jet apparatus has recently come to be employed in a printer or the like to output picture images or the like, much higher picture quality has come to be demanded. As for conventional means for improving picture quality, there are methods in which density gradation is controlled by controlling the size of the ink droplet.

According to one such method, which is disclosed in Japanese Laid-Open Patent Application No. 132,259/1980, the density gradation of the ink jet is controlled by changing the amount of the ink ejected per picture element. More specifically, a plurality of heat generating resistors are disposed in a single liquid path, and the driving signals are selectively supplied to each heat generating resistor to change the amount of the ink ejected per picture element. The above publication discloses a structure in which two heat generating resistors are arranged in series in the direction in which the ink is ejected, and another structure which two heat generating resistors are arranged in parallel relative to the direction in which the ink is ejected.

However, the conventional methods have the following problems.

First, the structure in which the plurality of heat generating resistors in the same liquid path are arranged in series in the ink ejecting direction, will be described. When the configuration (area size) of one heat generating resistor is the same as the other, there is a difference in the location of the center of gravity, that is, the heat generating center, of each heat generating resistor, between when only one of the heat generating resistors is driven and when both of them are driven at the same time; therefore, the nozzle length must be extended. This problem can be solved by shortening the length (in the ink ejecting direction) of the heat generating resistor on the ejection orifice side. However, the change in the length of the heat generating resistor requires the change in the voltage to be applied to the heat generating resistor. In other words, when the length of the heat generating resistor on the ejection orifice side is shortened, the voltage to be applied to one heat generating resistor has to be substantially differentiated from the voltage to be applied to the other. As a result, there must be as many power sources as heat generating resistors.

Next, the structure in which the two heat generating resistors in the same flow path are arranged in parallel relative to the ejection direction will be described. When the center of gravity of the heat generating resistor is optimally adjusted to agree with a condition in which only one heat generating resistor is driven, the bubble generating power obtainable when both heat generating resistor are driven at the same time becomes too large, scattering the ink droplets. On the contrary, when the center of gravity of the heat generating resistor is optimally adjusted to agree with a condition in which two heat generating resistors are driven at the same time, the bubble generating power obtainable when the ink is to be ejected by driving only one heat generating resistor is liable to become insufficient to eject the ink as the ink droplet. In other words, when the heat generating resistors are arranged in parallel relative to the liquid ejecting direction, satisfactory picLure qudlity cannot be obtained whether two heat generating resistors are driven at the same time or only one heat generating resistor is driven.

The present invention was made to solve the above described problems related to the conventional methods, and its primary object is to provide an ink jet recording head and ink jet apparatus, which are provided with gradation control functions, being thereby enabled to excel in recording quality, and an ink jet recording method for effecting superior gradation.

SUMMARY OF THE INVENTION

The inventors of the present invention disclosed in this patent application made the following discoveries as the result of extensive studies of the problems described above; when the plurality of heat generating resistors within the ink flow path are arranged in parallel relative to the ejection direction, and the location of the center of gravity, that is, the heat generating center, of each heat generating resistor is differentiated from those of the others in the ejecting direction. more specifically, when the center of gravity, that is, the heat generating center, of the heat generating resistor is shifted so that the heat generating resistor which forms a smaller dot when driven alone can be displaced toward the ejection orifice side, the aforementioned problems can be solved.

Thus, the present invention proposes an ink jet head comprising ink ejection outlet for ejecting ink, a plurality of heat generating resistors for generating thermal energy contributable to ejecting the ink, and ink flow path comprising the plurality of the heat generating resistors and being in fluid communication with the ejection outlet, the heat generating resistors generating the thermal energy upon receiving a driving signal, so that a bubble is generated in the ink within the ink flow path to eject the ink through the ink ejection outlet; wherein the plurality of the heat generating resistors are arranged in parallel, relative to the ink ejecting direction, in the ink flow path, and the distances from the heat generating centers of the heat generating resistors to the ejection outlet are different.

Further, the present invention proposes an ink jet apparatus comprising: an ink jet head comprising ink ejection outlet for ejecting ink, a plurality of heat generating resistors for generating thermal energy contributable to ejecting the ink, and ink flow path comprising the plurality of the heat generating resistors and being in fluid communication with the ejection outlet, the heat generating resistors generating the thermal energy upon receiving a driving signal, so that a bubble is generated in the ink within the ink flow path to eject the ink through the ink ejection outlet; and signal supplying means for supplying the driving signal to the ink jet head; wherein the plurality of the heat generating resistors are arranged in parallel, relative to the ink ejecting direction, in the ink flow path, and the distances from the heat generating centers of the heat generating resistors to the ejection outlet are different.

Further, the present invention proposes an ink jet recording method for recording images with gradation using an ink jet head comprising ink ejection outlet for ejecting ink, a plurality of heat generating resistors for generating thermal energy contributable to ejecting the ink, and ink flow path comprising the plurality of the heat generating resistors and being in fluid communication with the ejection outlet, the heat generating resistors generating the thermal energy upon receiving a driving signal, so that a bubble is generated in the ink within the ink flow path to eject the ink through the ink ejection outlet; wherein the plurality of the heat generating resistors are arranged in parallel, relative to the ink ejecting direction, in the ink flow path, and the distances from the heat generating centers of heat generating resistors to the ejection outlet are different; and when the heat generating resistor disposed closest to the ejection outlet, among the plurality of the heat generating resistors, is driven alone, an ink droplet with the smallest volume is ejected.

With the provision of the above described structure, even when a plurality of heat generating resistors with various area sizes are disposed within a single ink flow path, the ink, can be stably ejected in any driving mode; therefore, the amount of the ink to be injected per picture element can be reliably varied, enabling to accomplish high quality gradation.

Further, gradation can be controlled without increasing the number of data pads; without increase in the number of the pads, contact reliability is improved. Therefore, it is possible to provide an ink jet head and an ink jet apparatus, which are capable of accomplishing stable gradation, and thereby realizing superior print quality.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The ink jet head and the ink jet apparatus in accordance with the present invention will be described with reference to the drawings.

The ink jet heads in the following embodiments of the present invention comprise a structure similar to that of the aforementioned conventional ink jet head; heat is generated by the heat generating resistor driven by the driving signals supplied from the driving signal supplying means of the ink jet apparatus to the ink jet head, and the generated heat causes the ink within the ink flow path to bubble, which in turn causes the ink within the ink path to be ejected toward the recording medium from the ejection orifice (ink ejection orifice) disposed so as to face the recording medium, effecting the character image, the picture images, and/or the like.

Further, the ink jet heads in the following embodiments are characterized in that each ink flow path is provided with a plurality of heat generating resistors so that control can be executed to accomplish high quality.

Next, the characteristic structures of the present invention, and the effects thereof, will be described in detail in the following embodiments.

Embodiment 1

Figure 1:
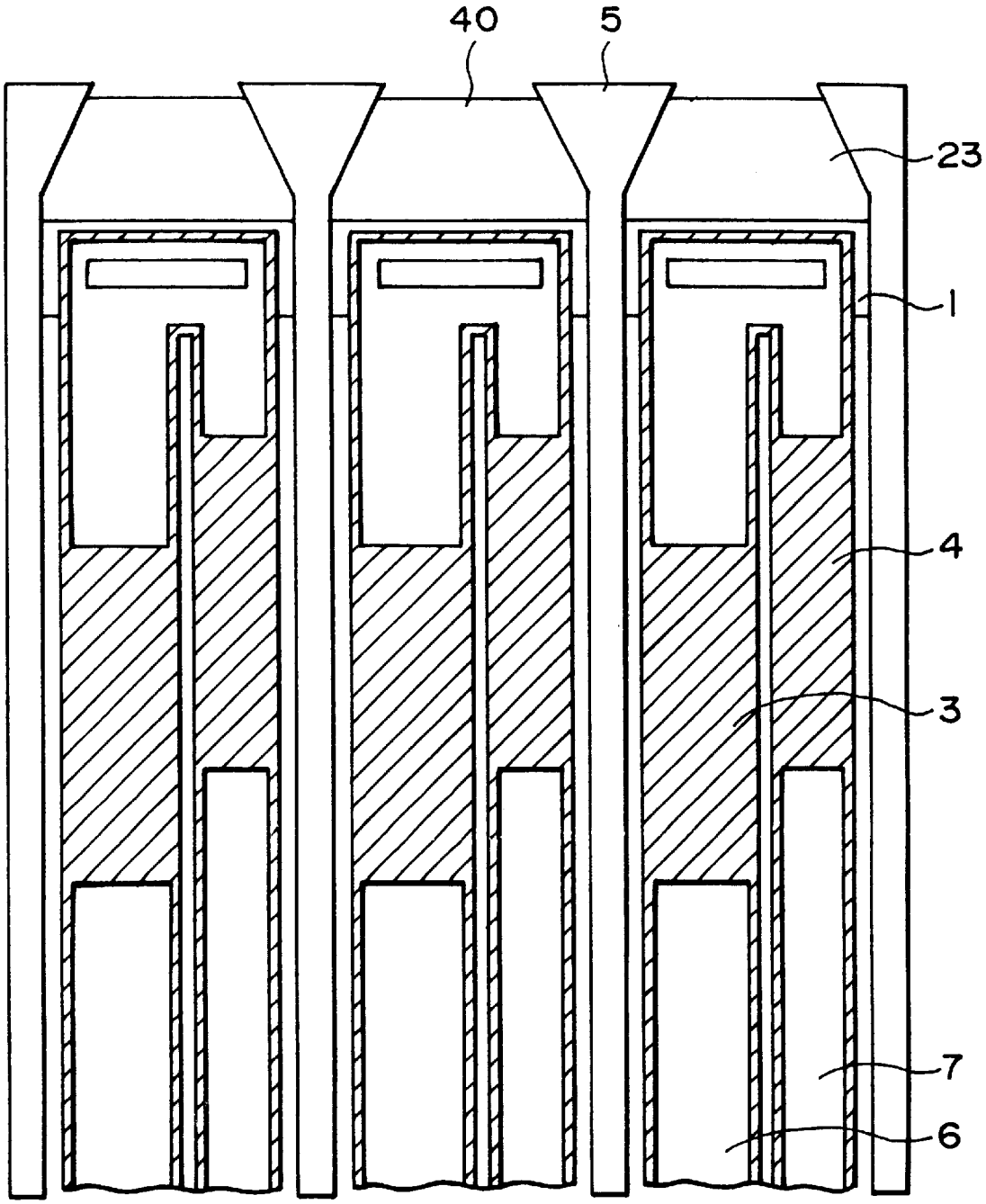
FIG. 1 is a schematic drawing showing the heat generating resistor arrangement in the first embodiment of the present invention.
Figure 2:
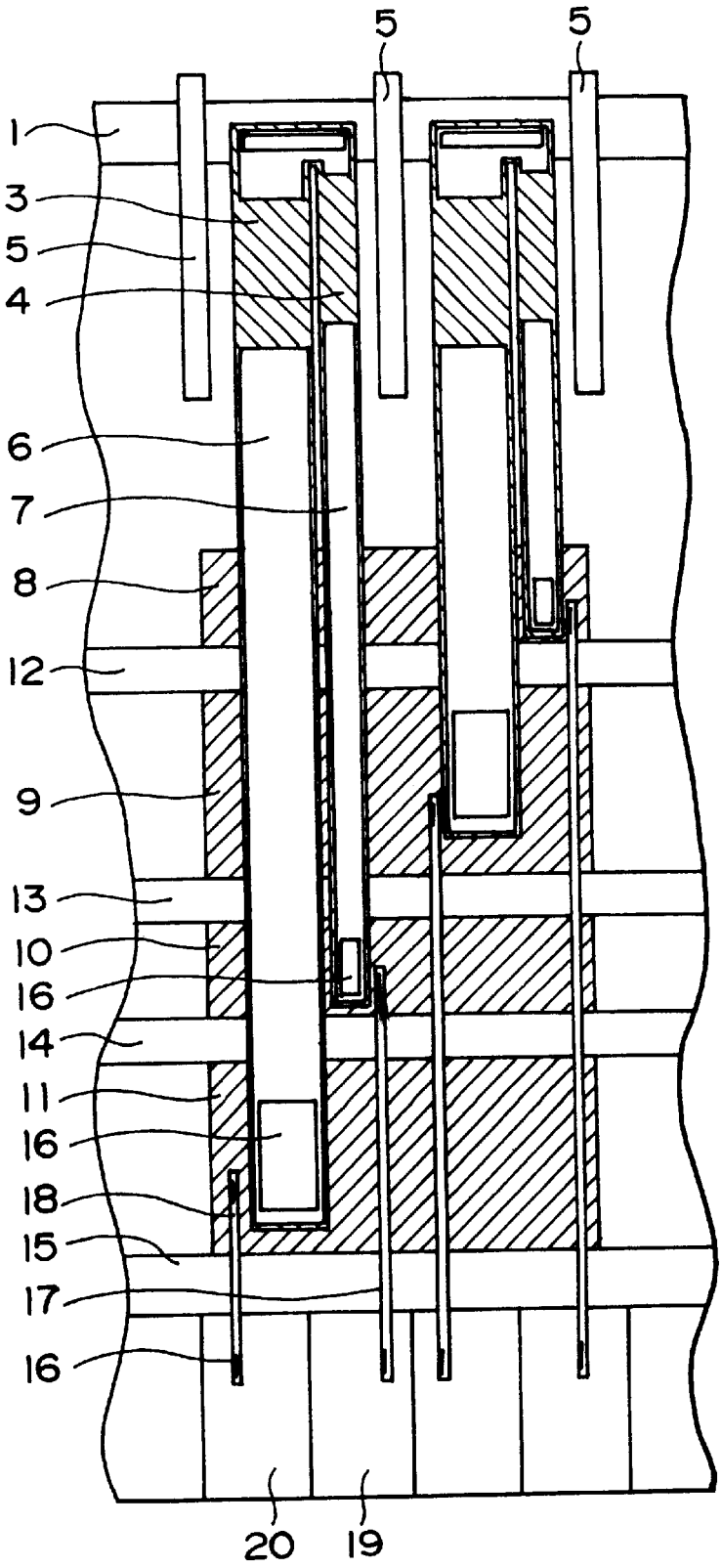
FIG. 2 is a schematic drawing showing the driving portion in the first embodiment of the present invention.

FIG. 1 is a schematic drawing showing the ink jet head arrangement on the substrate of the ink jet head in the first embodiment of the present invention, and FIG. 2 is a schematic drawing showing the electrical wiring for the heat generating resistor in the first embodiment.

Within each ejection ink flow path formed between the adjacent ink flow path walls 5, two heat generating resistors, that is, a first heat generating resistor 3 and a second heat generating resistor 4, are disposed, wherein the distance from one heat generating resistor to the ejection orifice 40 is differentiated from the distance from the other heat generating resistor to the ejection orifice 40. The heat generating resistors 3 and 4 are both connected to a common wiring 1 located under the insulation layer, that is, the layer directly below the heat generating resistor, and voltage is applied to the heat generating resistors 3 and 4 from this common wiring 1.

Wirings 6 and 7 are connected to the first heat generating resistor 3 and the second heat generating resistor 4, and switching transistors 10 and 11, through through holes 16, respectively. The switching transistors are also disposed under the insulation film, that is, the layer directly below the heat generating resistor. Signal wirings 17 and 18 for turning the transistors 10 and 11 on or off are connected to the transistors 10 and 11, and shift register-latch circuits 19 and 20, respectively.

With the above structure in place, data for driving the heat generating resistor are picked up by the shift register-latch circuits 19 and 20 to turn the transistors 10 and 11 on or off. Further, ground wirings 12, 13, 14 and 15 are connected to the emitters of the switching transistors 8, 9, 10 and 11, FIG. 3 is a schematic drawing depicting the general structure of the substrate in the first embodiment.

A substrate 23 comprises a plurality of consecutively disposed cells 25 constituting the common wiring 1 illustrated in FIGS. 1 and 2. The common wiring 1 is connected to contact 24, common vertical wiring 21, receiving power from an external power source. The ground wirings 12, 13, 14 and 15 are connected to the contact 24 by way of the vertical ground wiring 21.

Figure 3:
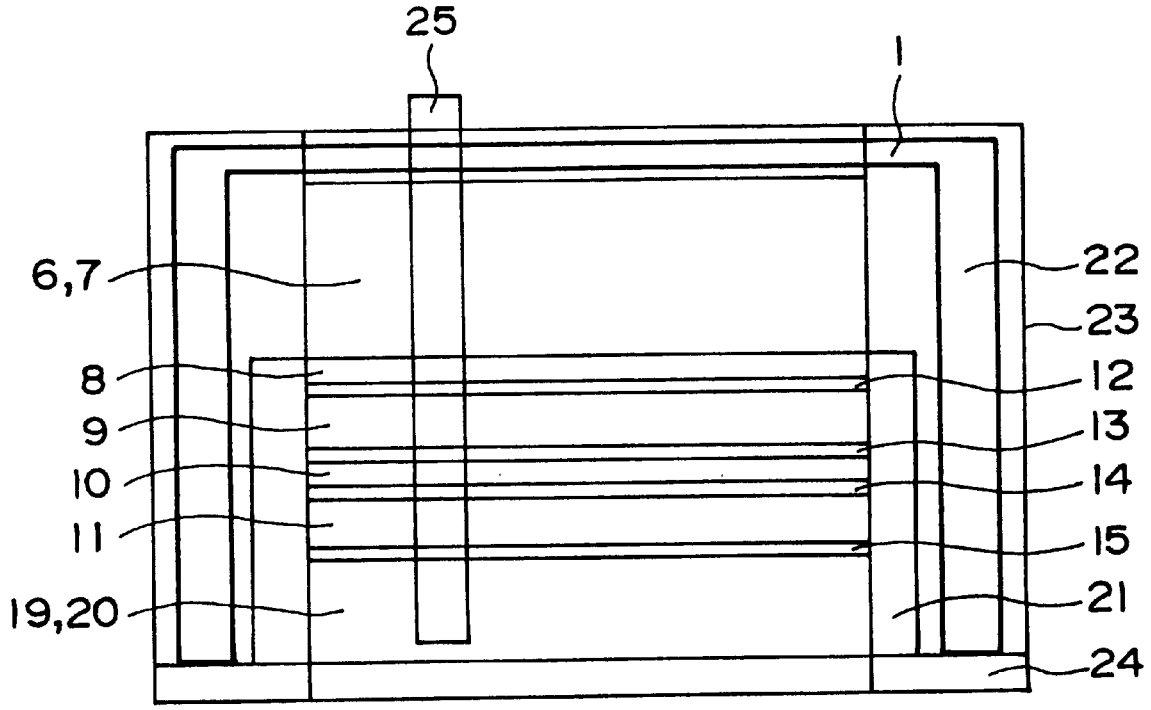
FIG. 3 is a schematic drawing showing the driving portion arrangement on the substrate in the first embodiment of the present invention.
Figure 4:
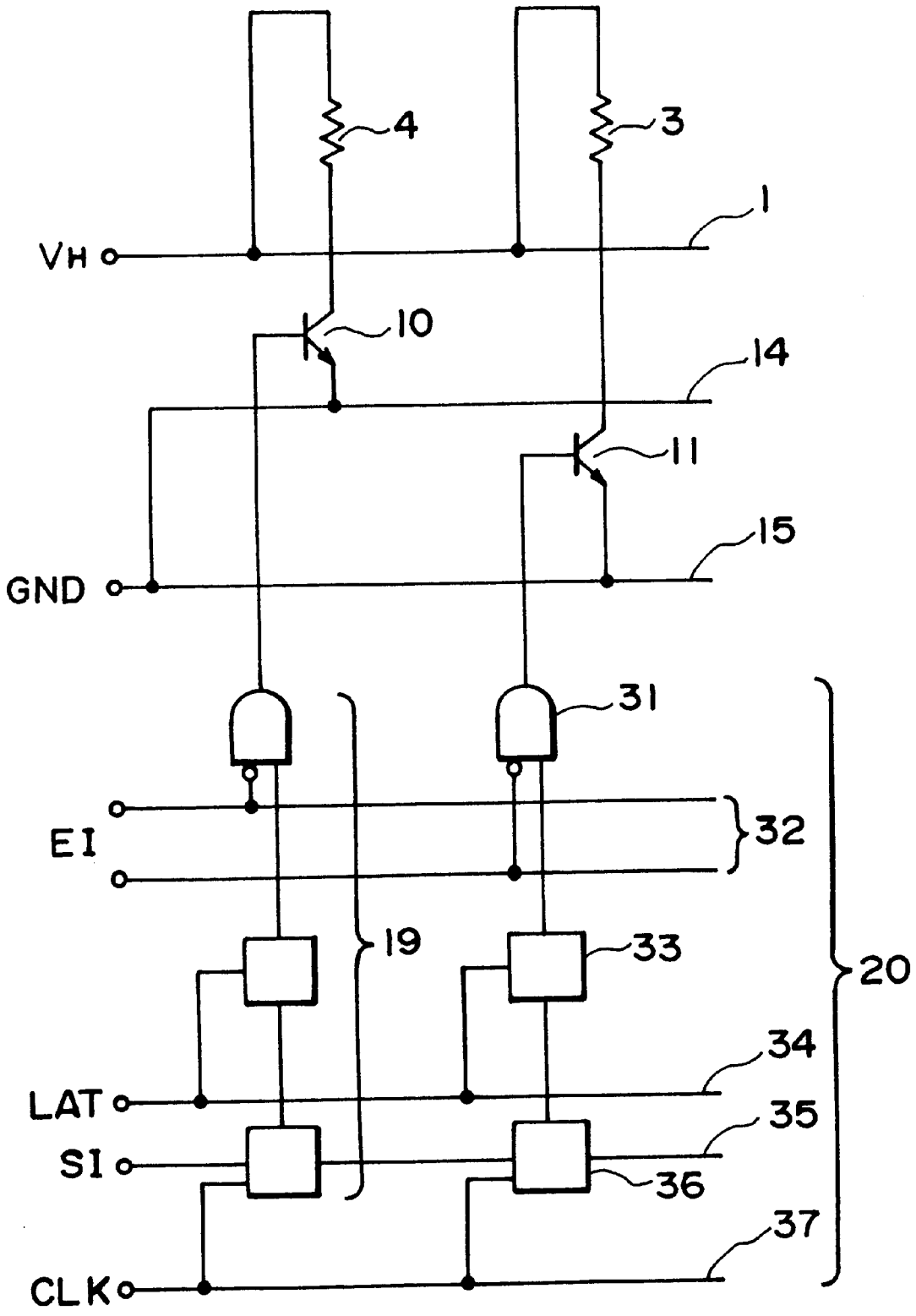
FIG. 4 is an equivalent circuit for driving the heat generating resistor in the first embodiment of the present invention.
Figure 5:
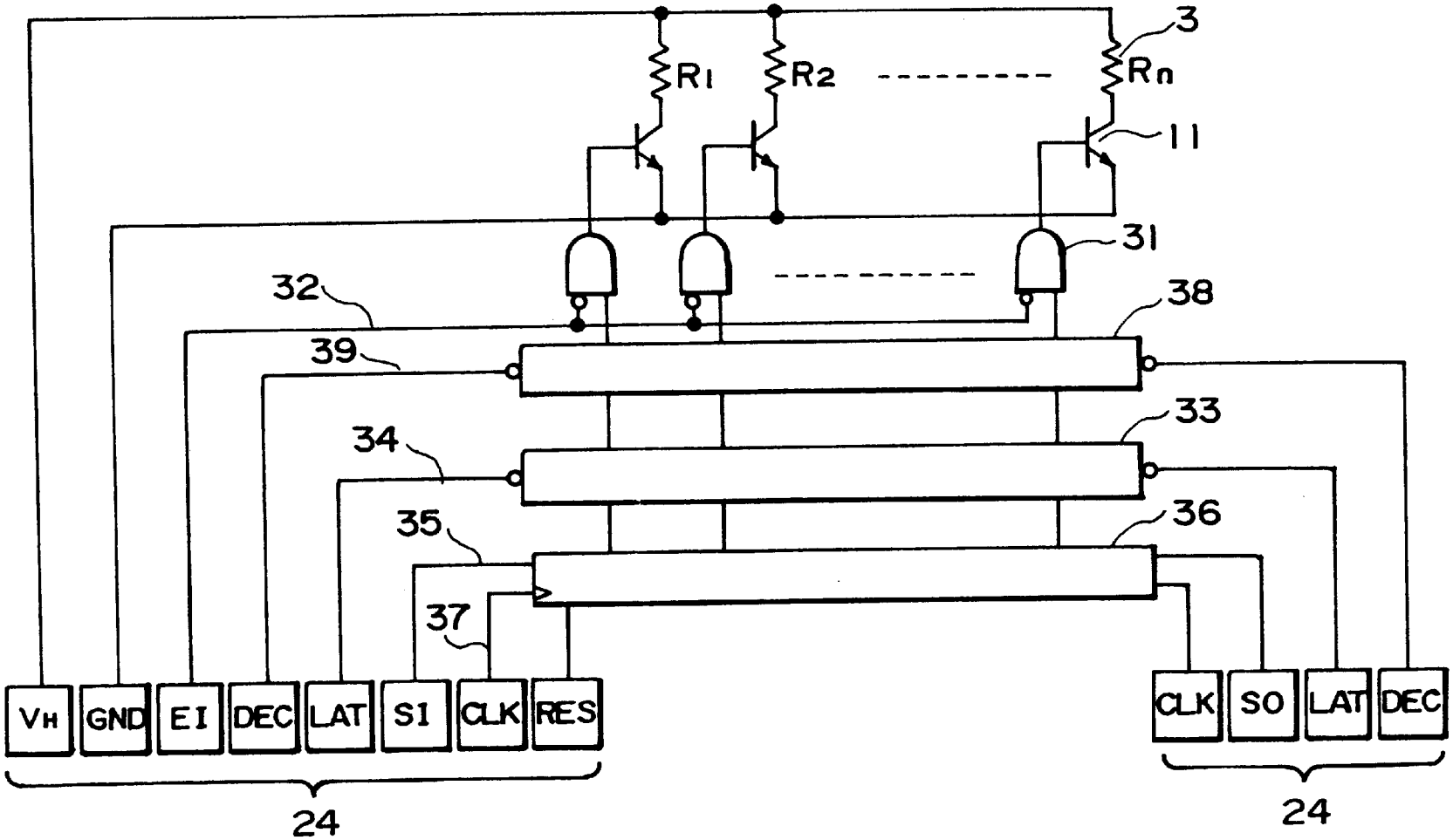
FIG. 5 is also an equivalent circuit for driving the heat generating resistor in the first embodiment of the present invention.

A circuit diagram equivalent to the structures illustrated in FIGS. 1, 2 and 3 is shown in FIGS. 4 and 5.

In FIG. 4, the shift register-latch circuits 19 and 20 are illustrated in detail. To the shift register 36, a clock signal line 37 and a serial data line 35 are connected, and the data are transferred to the shift register 36 in response to the clock signal. The data inputted into the shift register 36 are retained by the latch 33 in response to the latch signal sent through the latch signal line 34. An enable signal line 32 is connected to an AND gate 31 to input the timing signal for applying the data retained in the latch 33 to the.transistor 11. Since there are two enable signal lines 32, the heat generating resistors 3 and 4 can be driven with differed timings.

FIG. 5 is a circuit diagram equivalent to the general structure of the substrate 23 on which the plurality of the cells illustrated in FIG. 4 are consecutively disposed.

Figure 6:
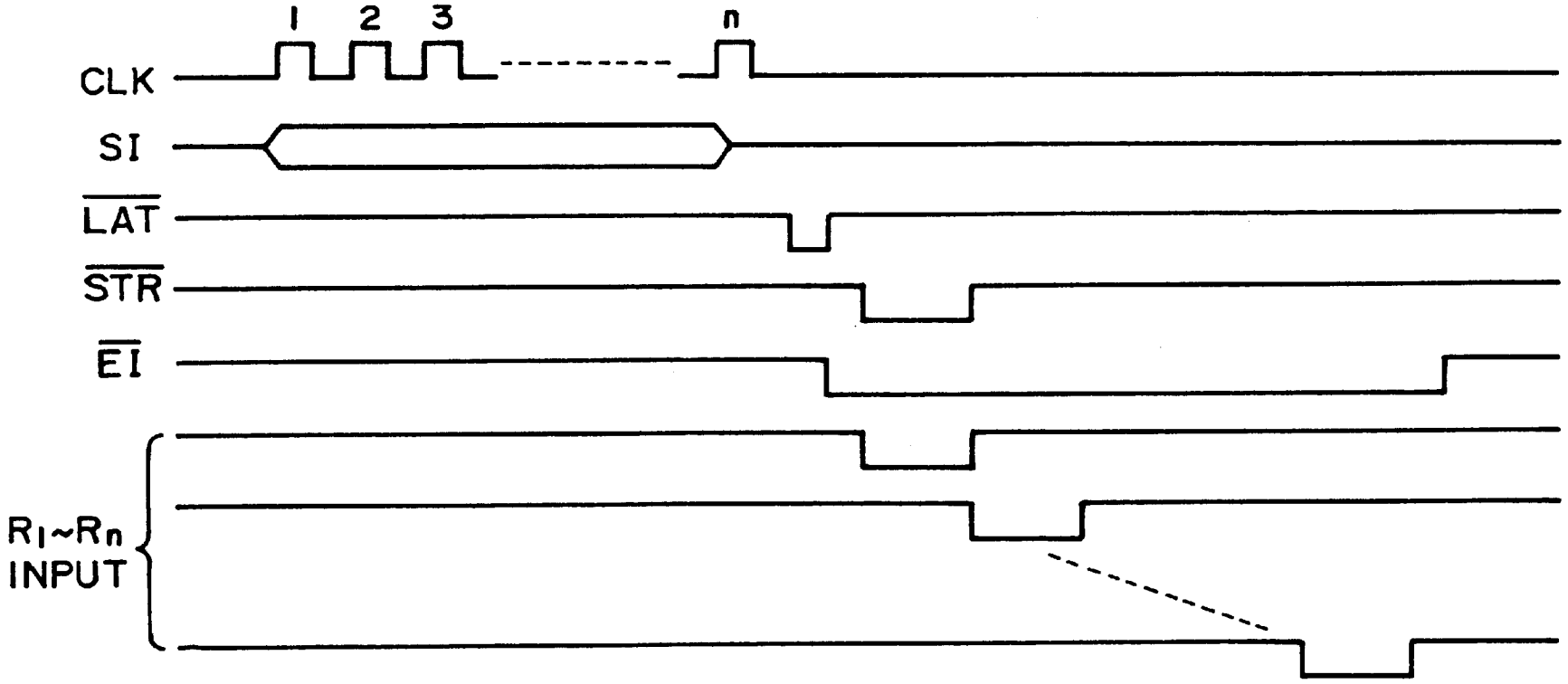
FIG. 6 is a timing chart for driving the head in the first embodiment of the present invention.

A decoder 38 and a decoder signal line 39, which are illustrated In FIG. 5, are for varying the driving timing, and are not provided with a plurality of the enable signal lines 32, being enabled to drive the heat generating resistor with various timings, without the need for a large number of contacts. The basic timing chart for the structure is given in FIG. 6.

Next, the control to be executed to stabilize the ink ejection, in terms of amount, by using the substrate 23 will be described.

The ink flow path confined between the adjacent ink flow path walls is filled with the ink which is heated by the first and second heat generating resistors 3 and 4 to generate bubbles. As a bubble is generated in the ink flow path, the ink is ejected from the ejection orifice 40 due to the pressure generated by the development of the bubble.

In this embodiment, the heat generating resistors 3 and 4 are disposed in parallel in terms of wiring, wherein the second heat generating resistor 4 for forming the smaller dot is disposed closer to the ejection orifice than the first heat generating resistor 3. In addition, the second heat generating resistor 4 has a smaller area size than the first heat generating resistor 3. The employment of this structure can reduce the amount of the ink between the second heat generating resistor 4 and the ejection orifice. Therefore, even when only the second heat generating resistor 4 is driven to produce an ink droplet which effects the smaller dot, the ejection failure or the like, which occurs due to unavailability of a sufficient amount of the bubble generation power, is not liable to occur. Further, the center of gravity, that is, the heat generating center, of the first heat generating resistor 3 is disposed more rearward (on the ink supply port side) than the center of gravity, that is, the heat generating center of the second heat generating resistor 4. Therefore, even when the second heat generating resistor 4 and the first heat generating resistor 3 are driven at the same time to form an ink droplet which effects a larger dot, the ink is not liable to be scattered by an excessive supply of the bubble generation power. Incidentally, the location of the integral center of gravity of the second heat generating resistor 4 and the first heat generating resistor 3 is determined by how the second heat generating resistor 4 and the first heat generating resistor 3 are arranged. For the sake of convenience, the distance from the second heat generating resistor 4 to the edge of the ejection orifice may be set to be half the distance between the first heat generating resistor 3 to the edge of the ejection orifice. This is because in a recent ink jet head in which the ink flow paths are disposed in high density, the size of the second heat generating resistor 4 which is disposed closer to the ejection orifice must be rendered relatively larger, whereas lt is impossible to increase the size of the first heat generating resistor 3 too excessively relative to the size of the second heat generating resistor 4.

As for the method for forming a larger dot, there are other methods beside the aforementioned one. For example, the larger dot can be also formed by driving only the first heat generating resistor 3. Further, three levels of gradation can be effected by driving only the second heat generating resistor 4, by driving only the first heat generating resistor 3, or by driving both the first and the second heat generating resistors 3 and 4 at the same time. However, as described before, in the recent ink jet head in which a plurality of the heat generating resistors are disposed in parallel in the ink flow path, it is sometimes difficult to substantially differentiate the area size of the smaller heat generating resistor from that of the larger heat generating resistor, which makes it difficult to effect distinct difference in gradation level; therefore, it is preferable that when the smaller dot is to be formed, only the second heat generating resistor disposed closer to the ejection orifice is driven, and when the larger dot is formed, both the first and the second heat generating resistors are driven at the same time.

When images were recorded using the ink jet head in accordance with this embodiment, preferable ejection was maintained for both the smaller dots and the larger dots, accomplishing high quality in terms of gradation.

Embodiment 2

When images were recorded with two levels of gradation using the ink jet head described in the first embodiment, the ink sometimes failed to be preferably ejected due to insufficiency in the bubble generation power. This phenomenon was related to the physical properties of the ink. Therefore, in this embodiment, the area size of the heat generating resistor closer to the ejection orifice, which is to be driven alone, is rendered larger than that of the heat generating resistor closer to the supply port in order to solve the above problem.

Figure 10:
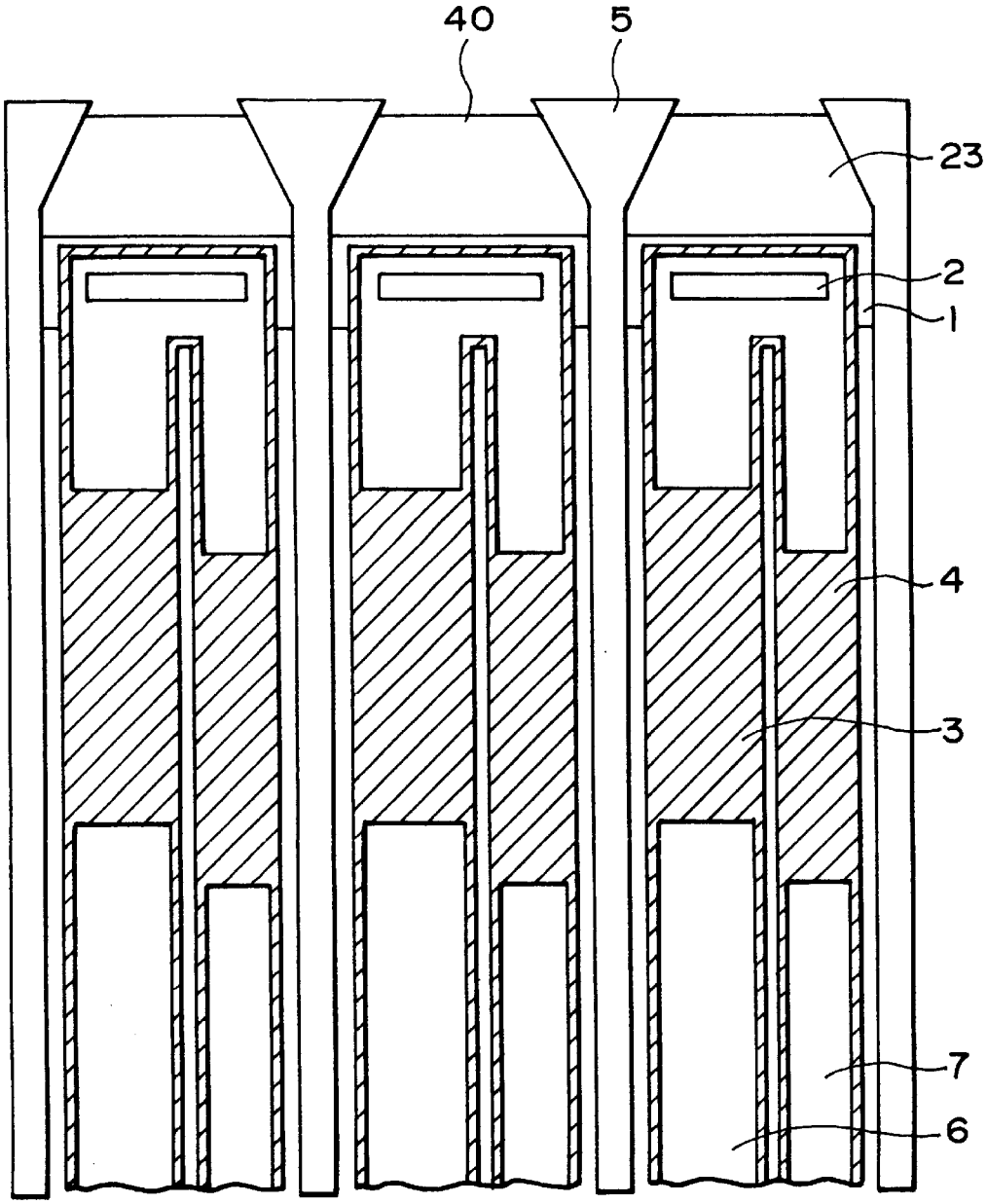
FIG. 10 is a scheiatic drawing showing the heat generating resistor arrangement in the second embodiment of the present invention.

FIG. 10 is a schematic drawing showing the heat generating resistor arrangement in this second embodiment.

In this embodiment. the locations of the first and the second heat generating resistors 3 and 4 are reversed with reference to the first embodiment; the heat generating resistor with the larger area size was disposed closer to the front (ejection orifice side), and the heat generating resistor with the smaller area size was disposed closer to the rear (supply port side). When the area size of the heat generating resistor closer to the ejection orifice, which is to be driven alone, is sufficiently increased, the ink can be preferably ejected even when the heat generating resistor is driven alone, allowing control to be executed to effect high quality gradation.

Further, in this embodiment, the only requirement is for the heat generating resistor closer to the ejection orifice to have a sufficiently large area size. In other words, it is not mandatory for the heat generating resistor closer to the supply port to be rendered smaller than the heat generating resistor closer to the ejection orifice. Therefore, when sufficient space is available in the ink flow path, two heat generating resistors may be given an equal area size.

When the ink jet head in this embodiment was subjected to a printing test, the ink was preferably ejected for both the smaller and the larger dots, accomplishing high quality in terms of gradation.

In the preceding embodiments, the present invention was described with reference to the ink jet head in which two heat generating resistors were disposed in a single ink flow path, but it is obvious that the present invention is also applicable to a head in which three or more heat generating resistors are disposed in a single ink flow path.

Next, the ink jet head in accordance with the present invention, and the ink jet apparatus compatible with such an ink jet head, will be described in more detail.

The present invention is usable with any ink jet system. However, when it is applied to an ink jet head or an ink jet apparatus employing an ink jet system of a particular type in which thermal energy is used to form flying liquid droplets which effect images, the most preferable effects can be obtained.

The typical structure and the operational principle are preferably the ones disclosed in U.S. Pat. Nos. ,4,723,129 and 4,740,796. It is preferable that the present invention be used in conjunction with the principles disclosed in these documents.

Next, the aforementioned ink jet system will be concisely described.

The heat generating resistor is disposed so as to face a sheet or an ink flow path in which liquid (ink) is held. The thermal energy for triggering the film boiling phenomenon at the interface between the heat generating resistor and the liquid is generated with the application of at least one driving signal which is correspondent to recording data, and is capable of increasing the liquid temperature to the film boiling point above the nucleation boiling point. Since this system can form bubbles in the liquid (ink), one bubble for one driving signal, in response to the driving signals applied to the heat generating resistor, it is particularly suitable for an on-demand type recording method. The development and contraction of the bubble forms at least one liquid droplet while ejecting the liquid from the ejection orifice. The driving signal is preferred to be in the form of a pulse signal since a pulse signal, which can instantly generate bubbles, and also can allow the bubbles to instantly contract, can eject the ink with preferable response. As for the types of the driving signal in a pulse form, those disclosed in U.S. Pat. Nos. 4,463,359 and 4,345,262 are preferable. In addition, the temperature increasing rate of the heating surface is preferably such as disclosed in U.S. Pat. No. 4,313,124.

The structure of the ink jet head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 138461/1984 wherein an opening for absorbing pressure wave of the thermal energy is formed corresponding to the ejecting orifice.

The present invention is effectively applicable to a so-called full-line type ink jet head having a length corresponding to the maximum recording width. Such an ink jet head may comprise a single ink jet head and plural ink jet head combined to cover the maximum width.

In addition, the present invention is applicable to a replaceable chip type ink jet head which is connected electrically with the main apparatus and can be supplied with the ink when it is mounted in the main assembly, or to a cartridge type ink jet head having an integral ink container.

The provisions of the recovery means and/or the auxiliary means for the preliminary operation are preferable, because they can further stabilize the effects of the present invention. As for such means, there are preliminary heating means which may be the heat generating resistor, an additional heating element, or a combination thereof. Also, means for effecting preliminary ejection (not for the recording operation) can stabilize the recording operation.

The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below room temperature but liquefied at room temperature. Since the ink is controlled within the temperature not lower than 30° C. and not higher than 70° C. to stabilize the viscosity of the ink to provide the stabilized ejection in a usual recording apparatus of this type, the ink may be such that it is liquefied as the recording signal is applied. In addition, the temperature rise which occurs to the head due to the thermal energy, or the excessive temperature rise of the ink, can be positively prevented by consuming it.for the state change of the ink from the solid state to the liquid state. Further, the ink which solidifies when unattended may be employed to solve the problem related to ink evaporation. In other words, the present invention is also compatible with the ink which can be liquefied, being thereby ejected in liquid state, by the application of the recording signal, and begins solidifying by the time it reaches the recording medium. Such an ink material may be retained as a liquid or solid material in through holes or recesses formed in a porous sheet as disclosed in Japanese Laid-Open Patent Application No. 56,847/1979 and Japanese Laid-Open Patent Application No. 71,260/1985. The sheet is faced to the heat generating resistor.

The most effective system for the ink materials described above is the film boiling system.

The application of the ink jet head and the ink jet apparatus in accordance with the present invention is not limited to a printer; they may be also applied to a textile printing apparatus which ejects ink for the purpose of dyeing, a pen plotter, or the like.

Figure 7:
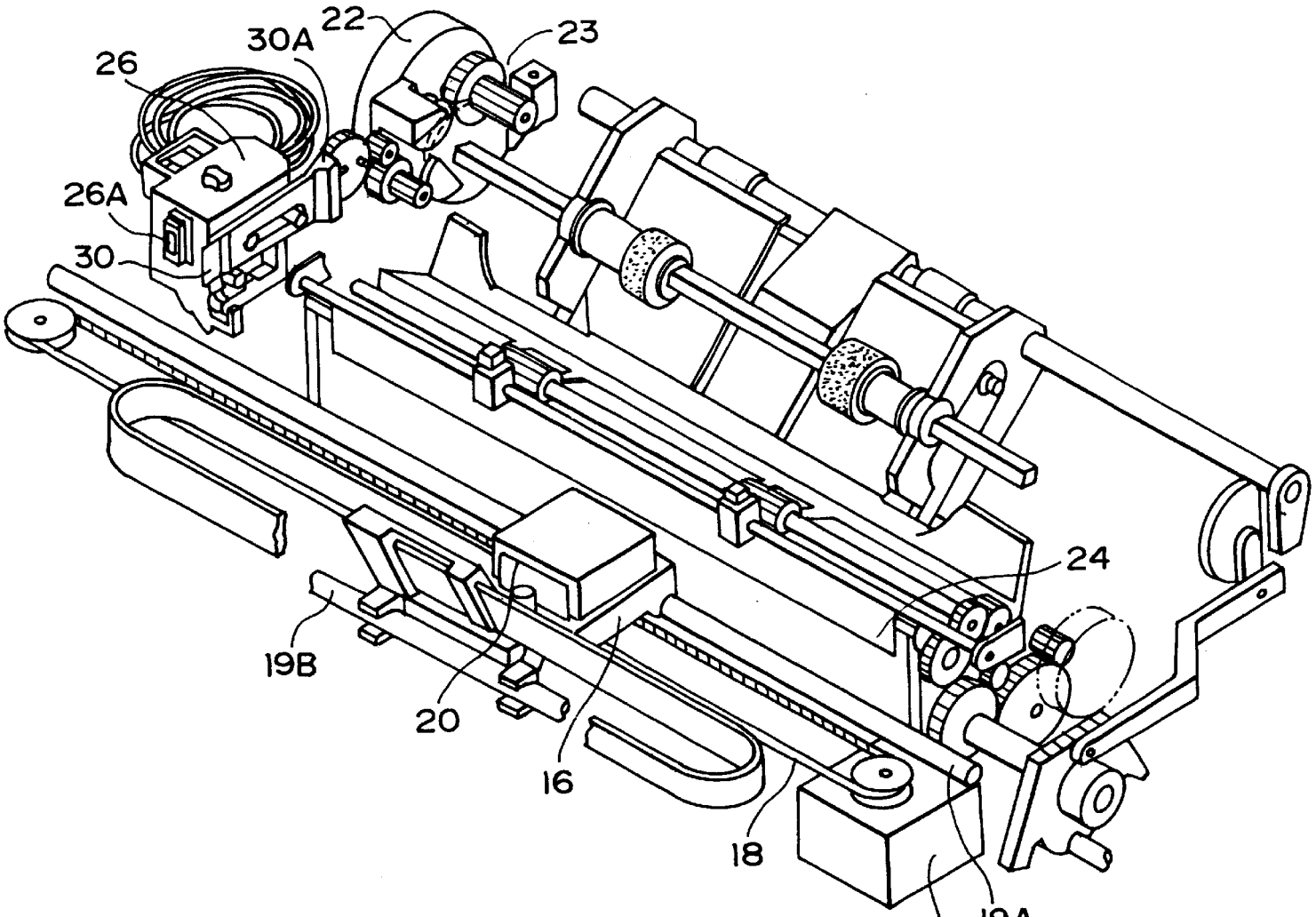
FIG. 7 is a perspective view of an ink jet apparatus in which the ink jet head in accordance with the present invention can be mounted.
Figure 8:
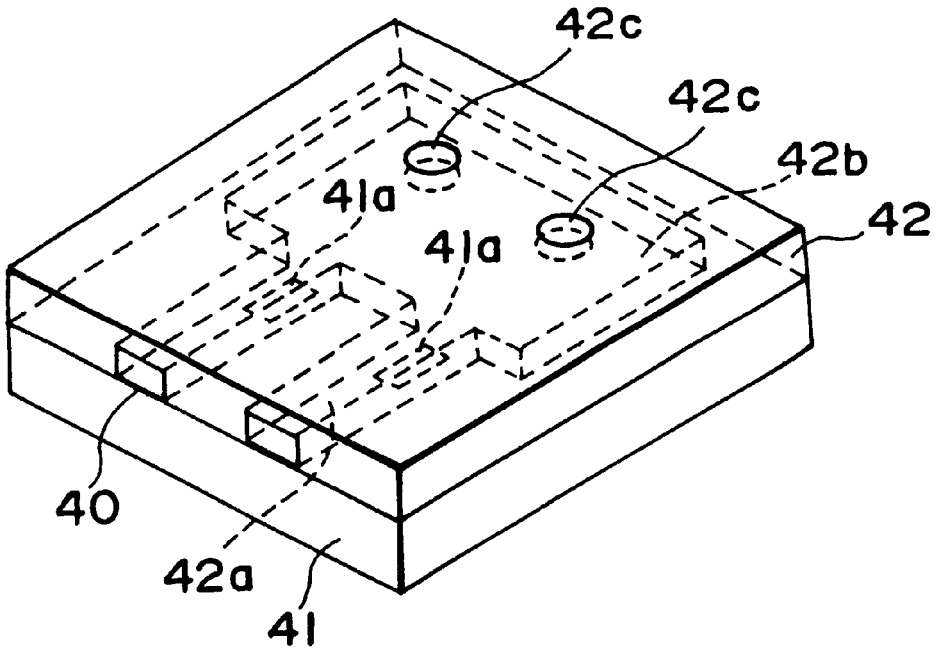
FIG. 8 PRIOR ART
FIG. 8 is a schematic perspective view of a conventional ink jet head.
Figure 9:
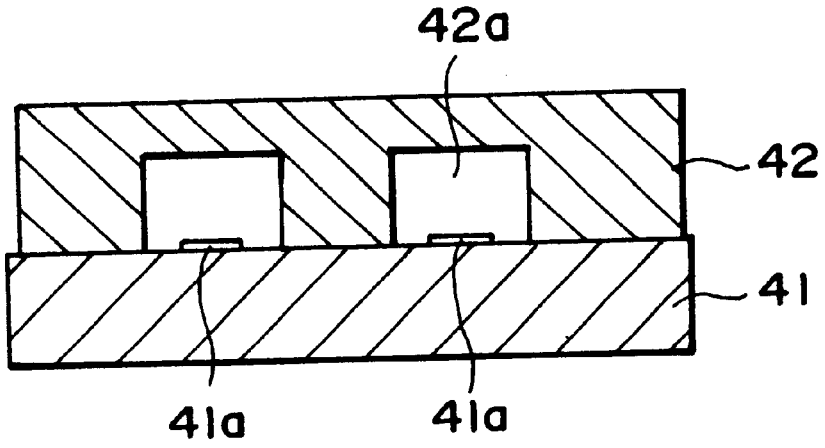
FIG. 9 PRIOR ART
FIG. 9 is a schematic section of the conventional ink jet head.

FIG. 7 is a perspective view of an example of an ink jet apparatus (IJA) in which the ink jet head in accordance with the present invention is installed as a part of an ink jet head cartridge (IJC)

In the drawing, a reference numeral 20 designates an ink jet head cartridge (IJC) comprising a group of ink flow paths from which ink is ejected onto the recording surface of the recording sheet as the recording medium delivered onto a platen 24. A reference numeral 16 designates a carriage (HC) which holds the IJC 20. The carriage 16 is connected to a part of a driving belt 18 which transmits the driving force from the a driving motor 17, and is set across two guide shafts 19A and 19B, being enabled to slide thereon, so that the IJC 20 can be reciprocally moved across the entire width of the recording sheet.

A reference numeral 26 designates a head performance recovery apparatus. It is disposed adjacent to one end of the moving path of the IJC 20, for example, at a location correspondent to the home position. The IJC 20 is capped with a cap 26A by a driving force transmitted from a motor 22 through a transmission mechanism 23. The IJC 20 is capped at the end of a recording operation or the like so that the IJC can be protected.

A reference numeral 30 designates a blade as a wiping member formed of silicone rubber. The wiping member 30 is disposed on one of the side walls of the head performance recovery apparatus 26, being extended like a cantilever by a blade holding member 30*a*. It is moved also by the motor 22 and the transmission mechanism 23 as is the head performance recovery apparatus 26, and is enabled to come in contact with the liquid ejection surface of the IJC 20. With the provision of the above structure, the blade 30 is extended into the moving path of the IJC 20. With a proper timing synchronized with the recording movement of the IJC, or after an ejection performance recovery operation carried out by the heat performance recovery apparatus 26, so that liquid such as residual ejection liquid or dew formed on the ejection orifice surface due to condensation, dust, or the like, is wiped away as the IJC 20 moves.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus for recording images with gradation, comprising:

an ink jet head, including an ink ejection outlet for ejecting an ink, an ink flow path in fluid communication with said ink ejection outlet, a first resistor, provided in said ink flow path, for generating thermal energy contributable to ejecting the ink, said first resistor having a heat generating center which is separated from said ejection outlet by a first distance, a second resistor, provided in said ink flow path, for generating thermal energy contributable to ejecting the ink, said second resistor having a heat generating center which is separated from said ejection outlet by a second distance which is larger than the first distance; and control means for controlling said first and said second heat generating resistors, said controlling means causing said first heat generating resistor alone to eject the ink through said ink ejection outlet with a first volume, and causing both of said first and said second resistors to eject the ink through said ink ejection outlet with a second volume which is greater than the first volume.

* * * * *